United States Patent [19]

Wempe et al.

[11] 4,114,783

[45] Sep. 19, 1978

[54] EDUCTION PIPE WITH GUIDE SLEEVE AND SEAL TO DRAW LIQUID FROM THE BOTTOM AND ALLOW TELESCOPING WHEN TANK TOP MOVES DOWN UNDER IMPACT

[75] Inventors: Richard J. Wempe; Richard B. Polley, both of St. Charles, Mo.

[73] Assignee: ACF Industries, Incorporated, New York, N.Y.

[21] Appl. No.: 827,129

[22] Filed: Aug. 24, 1977

[51] Int. Cl.[2] ..... B61D 5/00; B65D 83/14

[52] U.S. Cl. ..... 222/398; 137/590; 220/85 S; 222/464

[58] Field of Search ..... 220/85 S, 86 R; 222/377, 382, 398, 464, 394; 137/577, 590, 592; 105/358

[56] References Cited

U.S. PATENT DOCUMENTS

| | | | |
|---|---|---|---|
| 1,748,185 | 2/1930 | Nichols et al. | 222/85 S |
| 1,894,655 | 1/1933 | Auchincloss | 220/86 R |
| 2,083,776 | 6/1937 | Ferguson | 222/464 X |
| 2,294,543 | 9/1942 | Ellis | 220/85 S |
| 2,767,890 | 10/1956 | Carter | 222/382 X |

FOREIGN PATENT DOCUMENTS

| | | | |
|---|---|---|---|
| 2,550,950 | 5/1977 | Fed. Rep. of Germany | 220/85 S |

*Primary Examiner*—David A. Scherbel
*Attorney, Agent, or Firm*—Henry W. Cummings

[57] ABSTRACT

In accordance with the present invention a low profile sump is provided in the bottom of a railway tank car which does not extend below the tank sufficiently far as to require a skid. The eduction pipe includes a lower fixed eduction pipe portion which extends into the lower portion of the sump, and an upper movable eduction pipe portion which telescopically engages the lower eduction pipe portion for a distance at least equal to the distance that the tank top moves downwardly relative to the tank bottom when the car is impacted. Preferably the movable upper eduction pipe telescopes within the fixed, lower eduction pipe. Preferably a seal is provided between the fixed and movable eduction pipe portions to prevent air leakage into the eduction pipe during the final stages of unloading.

13 Claims, 6 Drawing Figures

EDUCTION PIPE WITH GUIDE SLEEVE AND SEAL TO DRAW LIQUID FROM THE BOTTOM AND ALLOW TELESCOPING WHEN TANK TOP MOVES DOWN UNDER IMPACT

BACKGROUND OF THE INVENTION

U.S. Pat. No. 1,748,185 and 1,894,655 disclose sumps having eduction pipes wit guides which allow relative movement of the eduction pipe relative to the tank bottom within the sump when the car is impacted. The sump extends below the tank bottom an amount sufficient to allow movement of the eduction pipe downwardly without contacting the bottom of the sump.

However for large tank cars the sump must extend below the tank bottom a distance in excess of 1 inch to prevent the eduction pipe from striking the sump bottom when the car is impacted. Such contact can result in damage to the eduction pipe or tank. Current AAR regulations require that if the sump extends below the outside of the tank bottom more than 1 inch a skid is required. The skid adds weight to the car and requires material and labor to install.

SUMMARY OF THE INVENTION

The object of the invention is to provide an eduction pipe and sump assembly for tank cars in which the sump does not extend below the tank bottom sufficiently far as to require a skid, and which allows the eduction pipe to move downwardly relative to the tank bottom and sump when the car is impacted.

In accordance with the present invention a low profile sump is provided in the tank bottom which does not extend below the outside of the tank bottom sufficiently far as to require a skid. An eduction pipe includes a lower fixed eduction pipe portion which extends into the lower portion of the sump, and an upper movable eduction pipe portion which telescopically engages the lower eduction pipe portion for a distance at least equal to the distance that the tank top moves downwardly relative to the tank bottom when the car is impacted. Preferably the movable upper eduction pipe telescopes within the fixed lower eduction pipe. Preferably a seal is provided between the fixed and movable eduction pipe portions to prevent air leakage into the eduction pipe during the final stages of unloading. This leakage could result in pressure equalization which would render the eduction pipe inoperative if flow was interrupted after the liquid level was below the end of the upper movable eduction pipe.

THE DRAWINGS

DETAILED DESCRIPTION

Figure 1:
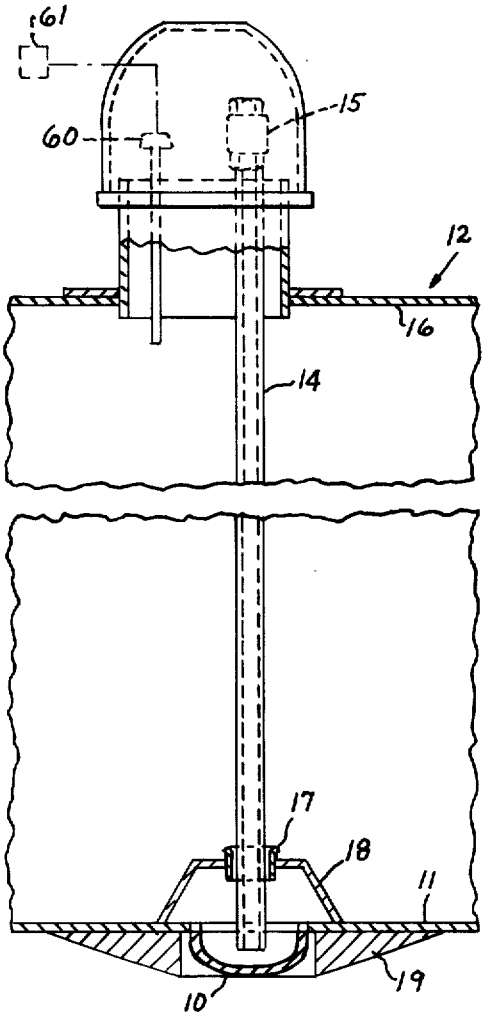
FIG. 1. PRIOR ART
FIG. 1 is a schematic sectional view of a sump and siphon arrangement of the prior art.
Figure 2:
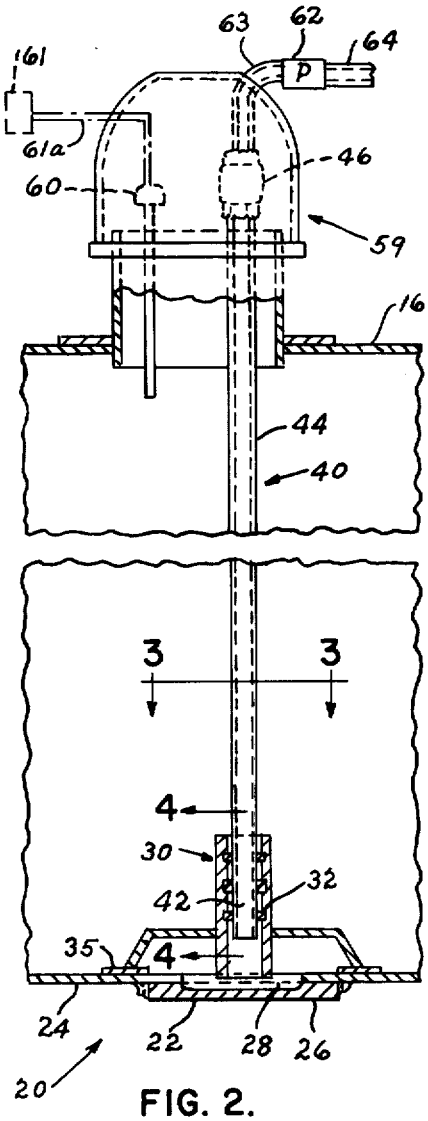
FIG. 2 is a schematic sectional view of the sump and siphon arrangement of the present invention.
Figure 3:
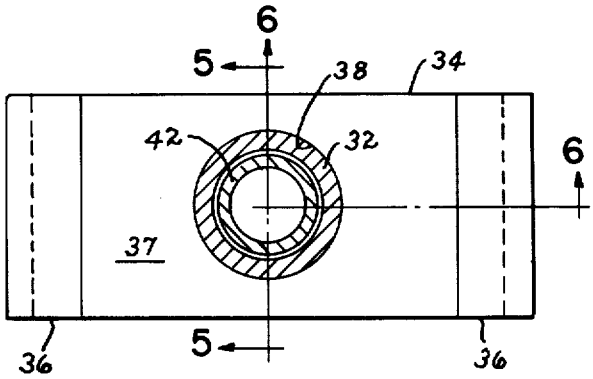
FIG. 3 is a plan view looking in the direction of the arrows along the line 3—3 in FIG. 2 illustrating the construction of the fixed siphon support.

In the usual eduction pipe-sump arrangement a sump 10 is provided in the bottom 11 of a railway tank car 12. An eduction pipe 14 having an outlet valve 15 extends from the top of the car 16 downwardly into the sump 10. A guide 17 having a support 18 is provided to facilitate the relative movement of the tank top 16 and eduction pipe 14, and the tank bottom 11 and sump 12 when the tank car is impacted. For large tank cars to accomodate this relative movement, the sump must be sufficiently deep that it extends below the outside of the tank bottom more than 1 inch, which according to AAR regulations requires a skid 19 to protect the sump in the event of impact to the sump or derailment. The skid adds weight to the car and added cost for labor and material.

In accordance with the present invention to avoid the requirement for a skid, the eduction pipe and sump assembly 20 is provided including a low profile sump 22 which extends only a short distance below the tank bottom 24. In order to comply with current AAR regulations, the sump should not extend further down than 1 inch. Sump 22 includes a flange portion 26 which is welded to tank bottom 24. A hollow sump portion 28 extends below the inside of tank bottom 24.

An eduction pipe indicated generally at 30 includes a lower fixed eduction pipe portion 32 which extends into hollow sump portion 28 and is suitably supported on the tank bottom 24, for example by a formed plate 34 including legs 36 welded to a plate 35 which is welded to the tank bottom, and a generally horizontal portion 37 having a generally central opening 38. Fixed eduction pipe 32 extends through opening 38 and is welded to horizontal plate portion 37.

A movable eduction pipe indicated generally at 40 includes a lower portion 42 which extends within fixed eduction pipe 32, and an upper movable eduction pipe portion 44 which extends through the top of the car 16 and is provided with a valve 46.

Figure 4:
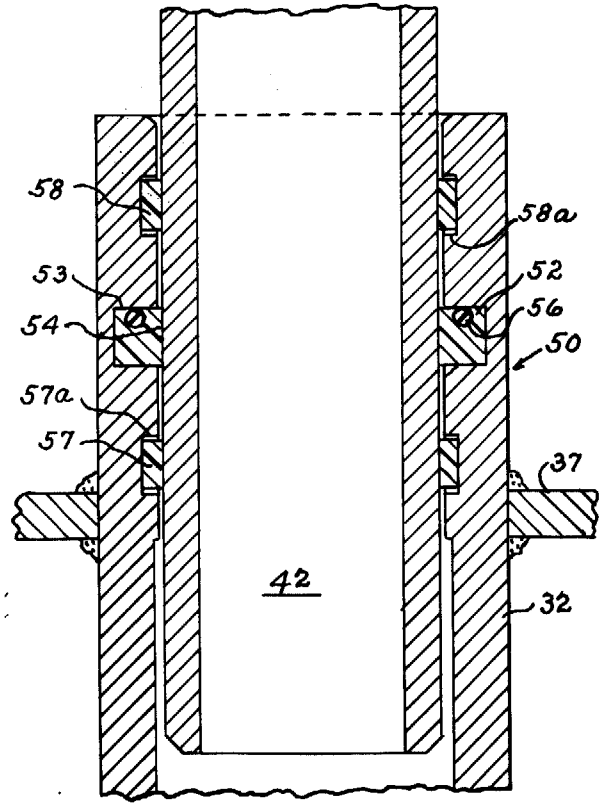
FIG. 4 is a partial sectional view looking in the direction of the arrows along the line 4—4 in FIG. 2 illustrating a seal arrangement between the fixed siphon portion and the movable siphon portion.

Means for sealing the movable eduction pipe with respect to the fixed eduction pipe is indicated generally at 50 and includes a lip seal 52 (FIG. 4) mounted within a groove 53 within a fixed eduction portion 32. Lip seal 52 includes a lip portion 54 of elastomeric material adapted to sealingly engage movable eduction pipe portion 42, and an o-ring 56 which urges lip seal 52 into engagement with movable eduction pipe portion 42. Wear rings 57 and 58 are provided in respective grooves **57*a* and 58*a***. The seal prevents air leakage into the eduction pipe during the last stages of unloading. This leakage could result in pressure equalization which would render the eduction pipe inoperative if flow was interrupted after the liquid level was below the end of the upper movable eduction pipe.

Means 59 are provided to provide a pressure differential between valve means 46 and the sump 28. An air inlet valve 60 of conventional construction is provided to apply pressure from a pressure source 61 through a conduit **61*a* to the lading to force the lading up through fixed eduction pipe 32 and through movable eduction pipe 40. Alternatively a conventional pump 62 may be connected to outlet valve 46 through a conduit 63. Seal 52 insures that a pressure differential is maintained between sump 22 and valve means 46 for successful unloading, particularly when the lading level is below the lower end of movable eduction pipe portion 42. An unloading hose or pipe 64** is attached to unloading valve 46 or to an unloading pump 62 to carry the lading to a receiving container (not shown).

Figure 5:
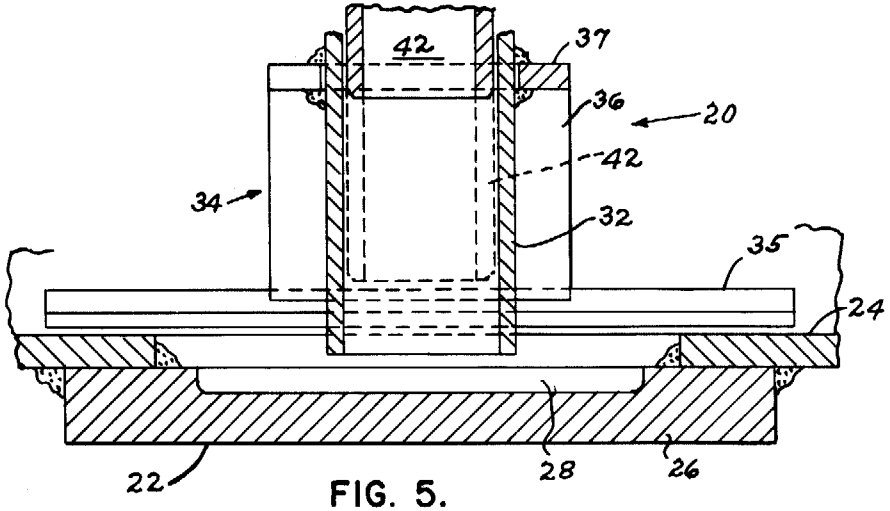
FIG. 5 is a partial sectional view looking in the direction of the arrows along the line 5—5 in FIG. 3.
Figure 6:
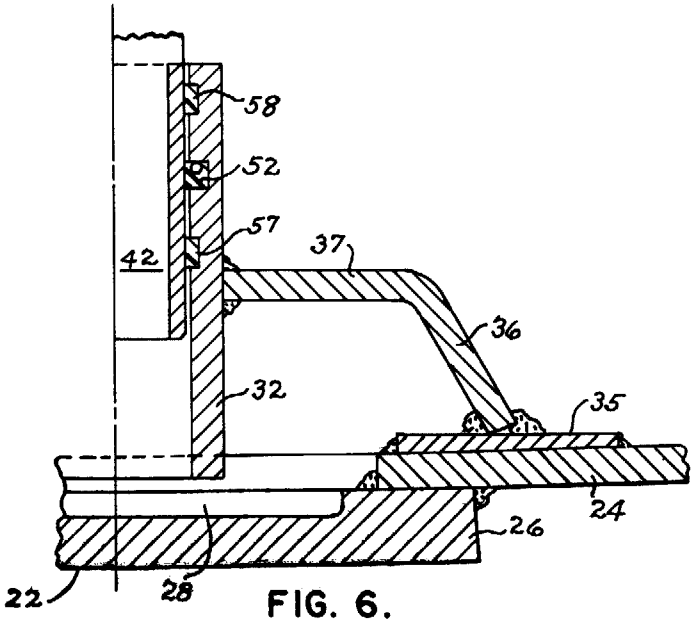
FIG. 6 is a partial sectional view of a portion of the siphon and sump arrangement looking in the direction of the arrows along the line 6—6 in FIG. 3.

When the car is impacted as during switching or over-the-rail operation, the tank top 16 and movable eduction pipe 40 move downwardly relative to the tank bottom 24. Movable eduction pipe portion 40 telescopes within fixed eduction pipe 32 as shown dotted in FIG. 5 to the extent that the tank top 16 moves downwardly relative to the tank bottom 24. Some up and down oscillatoy movement may occur between fixed eduction pipe 32 and movable eduction pipe 40 until the position shown in solid lines in FIG. 5 is again reached.

The low profile sump as constructed extends only a short distance below outside tank bottom 24, preferably not more than 1 inch to meet current AAR regulations so that a skid similar to skid 19 in FIG. 1 is not required. At the same time the tank top and movable eduction portion may move downwardly under impact without striking the bottom of the sump.

What is claimed is:

1. A sump and eduction arrangement for a railway tank car comprising:

a low profile sump located in an opening in the bottom of the tank and extending a short distance below the outside of said tank bottom; said sump including a sump hollow portion to collect lading for unloading;

an eduction pipe located above said sump including a fixed eduction pipe portion supported on said tank bottom including a hollow tube extending into said sump hollow portion, and a movable eduction pipe portion including a lower tubular portion telescopicly engaging said fixed eduction pipe portion and vertically movable relative to said fixed eduction pipe portion and an upper tubular portion extending to the upper portion of the tank; valve means for opening and closing communication between said eduction pipe and the outside of the tank; means for providing a pressure differential between said valve means and said sump whereby lading passes into said sump and then upwardly through said fixed eduction pipe portion and said movable eduction pipe portion and out of said tank, and whereby when the upper portion of said tank moves downwardly relative to the tank bottom said movable eduction pipe portion and said fixed eduction pipe portion telescope relative to one another during such downward movement.

2. A sump and eduction arrangement according to claim 1 wherein sealing means are provided between said fixed eduction pipe portion and said movable eduction pipe portion.

3. A sump and eduction arrangement according to claim 2 wherein said sealing means includes a lip seal having a lip elastomeric portion which engages said movable eduction portion and an o-ring which urges said lip portion into engagement with said movable eduction pipe portion.

4. A sum and eduction arrangement according to claim 3 wherein said sealing means includes at least one wear ring located between said fixed eduction portion and said movable eduction pipe portion.

5. A sump and eduction arrangement according to claim 4 wherein said sealing means includes a pair of wear rings vertically spaced above and below said lip seal.

6. A sump and eduction arrangement according to claim 1 wherein said movable eduction pipe portion telescopes within said fixed eduction pipe portion.

7. A sump and eduction arrangement for a railway tank car comprising: a low profile sump located in an opening in the bottom of the tank and extending a short distance below the outside of said tank bottom; said sump including a sump hollow portion located below the inside tank bottom to receive lading for unloading, an eduction pipe located above said sump including a fixed eduction pipe supported on said tank bottom extending into said sump hollow portion, and a movable eduction pipe portion telescopicly engaging said fixed eduction pipe portion and vertically movable relative to said fixed eduction pipe portion, and an upper tubular portion extending to the upper portion of the tank; seal means located between said fixed eduction pipe portion and said movable eduction pipe portion; valve means for opening and closing communication between said sump and the outside of said tank; means for providing a pressure differential between said sump and the outside of said tank whereby lading passes into said sump and then upwardly through said fixed eduction pipe portion and said movable eduction pipe portion to the outside of said tank; and whereby when the upper portion of said tank moves downwardly relative to the tank bottom said movable eduction pipe portion and said fixed eduction portion telescope relative to one another during such downward movement.

8. A sump and eduction arrangement according to claim 7 wherein said movable eduction portion telescopes within said fixed eduction portion.

9. A sump and eduction arrangement according to claim 8 wherein said sump includes a flange portion which engages the tank bottom and a hollow portion located radially inwardly from said flange portion.

10. A sump and eduction arrangement according to claim 9 wherein said sealing means includes a lip seal having a lip elastomeric portion which engages said movable eduction pipe portion and an o-ring which urges said lip portion into engagement with said movable eduction pipe portion.

11. A sump and eduction arrangement according to claim 10 wherein support means for said fixed eduction pipe portion includes a plate having inclined leg portions attached to the tank bottom on opposite sides of a horizontal portion having an opening through which said fixed eduction pipe portion passes.

12. A sump and eduction arrangement according to claim 11 wherein said sealing means includes at least one wear ring located between said fixed eduction pipe portion and said movable eduction pipe portion.

13. A sump and eduction arrangement for a railway tank car comprising:

a low profile sump located in an opening in the bottom of the tank and extending a distance not more than 1 inch below the outside of said tank bottom; said sump including a flange portion attached to said tank bottom and a hollow sump portion located radially inwardly from said flange portion and extending below the inside of the tank bottom to receive lading for unloading; an eduction pipe located above said sump including a fixed eduction pipe portion supported on said tank bottom including a hollow tube extending into said sump hollow portion, and a movable eduction pipe portion including a lower tubular portion extending within and telescopicly engaging said fixed eduction pipe portion and vertically movable relative to said fixed eduction pipe portion, and an upper tubular portion extending to the upper portion of the tank; seal means located in a groove within said fixed eduction portion including a lip seal having a lip elastomeric portion which engages said movable eduction pipe portion and an o-ring which urges said lip portion into engagement with said movable eduction pipe portion; valve means for opening and closing communication between said sump and the outside of the tank; means for pressurizing said tank whereby lading passes into said sump and then upwardly through said fixed eduction pipe portion and said movable eduction pipe portion to the outside of said tank, and whereby when the upper portion of said tank moves downwardly relative to the tank bottom, said movable eduction portion and said fixed eduction portion telescope relative to one another during such downward movement.

* * * * *